US005839301A

United States Patent [19]

Hsu

[11] Patent Number: 5,839,301

[45] Date of Patent: Nov. 24, 1998

[54] COMBINATION LOCK

[76] Inventor: Chung-Tung Hsu, No. 103, Wu-Kong Rd., Wu-Ku Ind. Park, Taipei Hsien, Taiwan

[21] Appl. No.: 944,180

[22] Filed: Oct. 6, 1997

[51] Int. Cl.[6] ..... E05B 37/06

[52] U.S. Cl. ..... 70/25; 70/312; 70/316

[58] Field of Search ..... 70/22, 24–29, 70/312, 315–318

[56] References Cited

U.S. PATENT DOCUMENTS

| | | | |
|---|---|---|---|
| 4,048,821 | 9/1977 | Bako et al. | 70/25 |
| 4,669,286 | 6/1987 | Cheng | 70/316 |
| 4,899,559 | 2/1990 | Chern | 70/25 |
| 4,970,881 | 11/1990 | Hsiao | 70/312 |
| 4,974,432 | 12/1990 | Blake | 70/68 |
| 5,765,409 | 6/1998 | Yang | 70/312 |

FOREIGN PATENT DOCUMENTS

| | | | |
|---|---|---|---|
| 504466 | 7/1930 | Germany | 70/29 |
| 2227515 | 8/1990 | United Kingdom | 70/24 |

*Primary Examiner*—Darnell M. Boucher
*Attorney, Agent, or Firm*—Bacon & Thomas

[57] ABSTRACT

A combination lock including a housing, a dial assembly, a press plate, and a latch means. When the dials are turned to a preset code, a hook may be pulled upwardly to cause a hook projection to extend out of a seat notch so that a first shaft post brings the entire dial assembly to displace to one side due to a clearance between a hook notch and a hook neck portion, so that shaft notches engage wedge-shaped projections on the housing. When the hook is pressed downwardly, the hook projection enters the seat notch so that the first shaft post enters the hook notch to cause a spring to reset, bringing the entire dial assembly to displace to the other side so that the shaft notches disengage from the wedge-shaped projections to achieve locking.

6 Claims, 3 Drawing Sheets

COMBINATION LOCK

BACKGROUND OF THE INVENTION (a) Field of the Invention

The present invention relates to a combination lock, and more particularly to a combination lock that is simple in construction and easy to set a new code.

(b) Description of the Prior Art

Combination locks are convenient devices since they eliminate the use of keys. They are widely used on brief cases, trunks, etc. They can also be used to lock doors and drawers. In the past, manufacturers preset the combination code of the lock. Now, the user can set the code himself/herself. The design of the code setting structure is therefore important as it affects the quality of combination lock products and determines whether or not the user can easily operate the lock and set the code.

The inventor of the present invention has obtained patents in the U.S. for a combination lock adapted for locking drawers (U.S. Ser. No. 08/622,625) and a combination lock with latch means (U.S. Ser. No. 08/622,629).

SUMMARY OF THE INVENTION

Accordingly, a primary object of the present invention is to provide an improved combination lock that can be easily operated.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENTS

Figures 1, 1A:
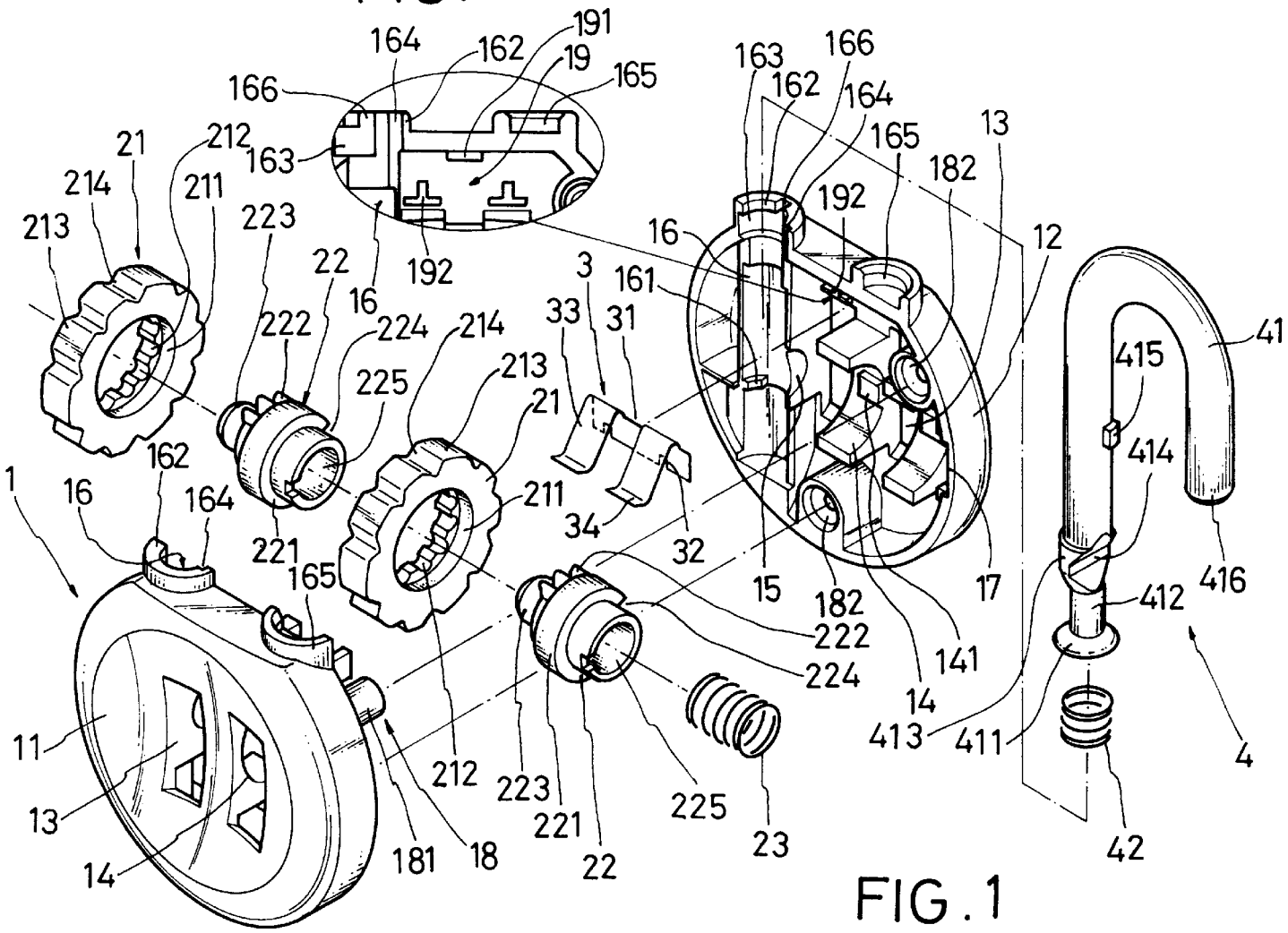
Fig. 1 is a schematic perspective exploded view of the combination lock of the present invention.
Fig. 1A is a schematic view of the positioning plate of the present invention.
Figure 3:
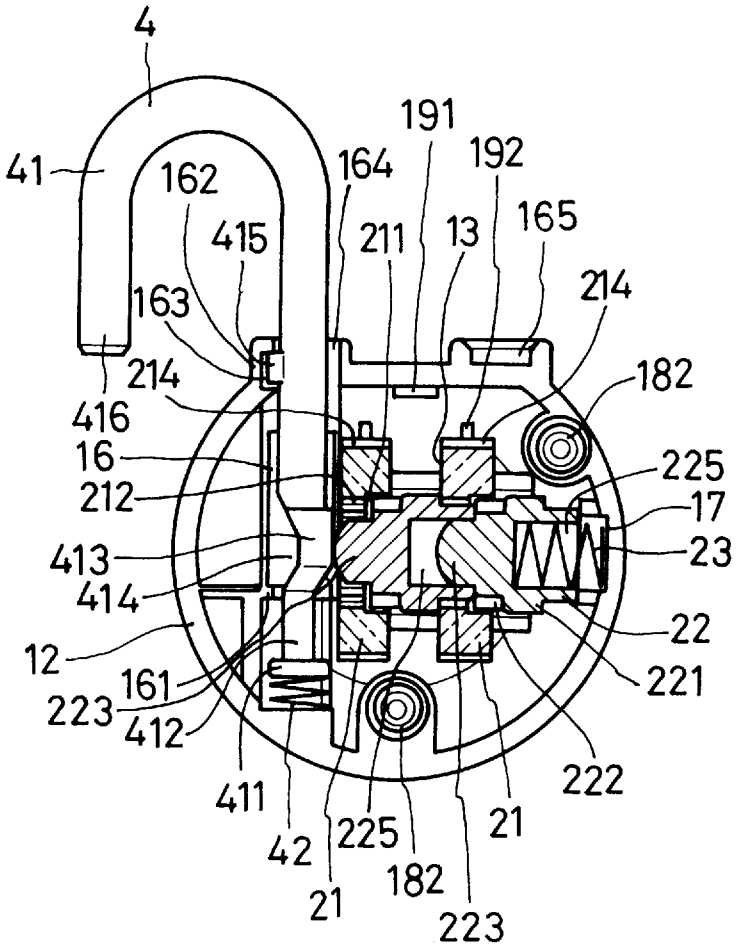
Fig. 3 is a schematic sectional view of the present invention illustrating the setting of a code.
Figure 2:
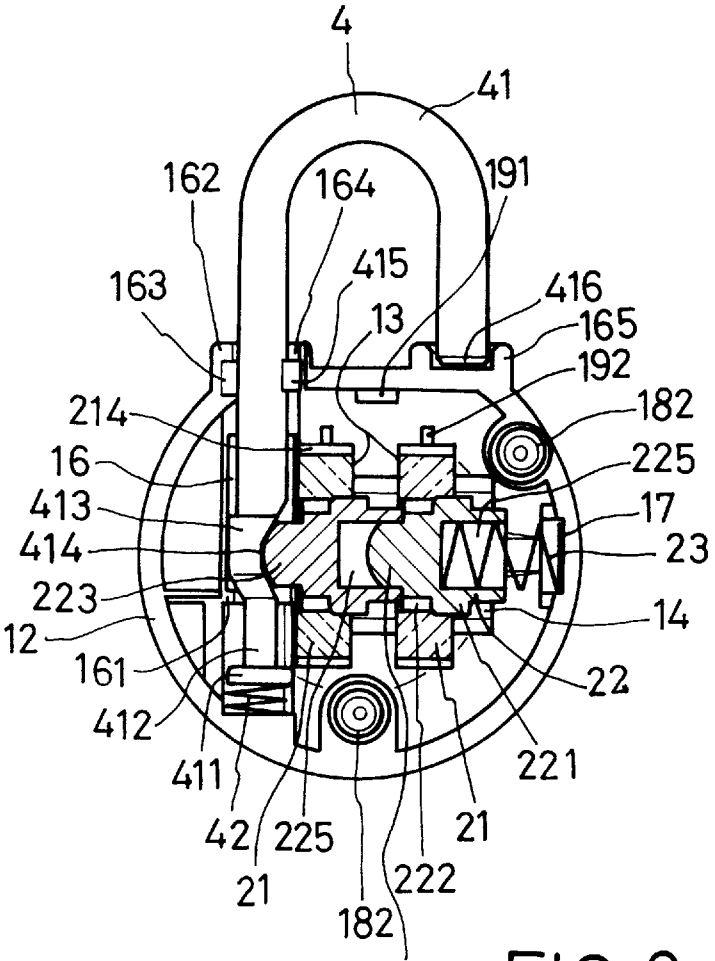
Fig. 2 is a schematic sectional view of the present invention showing the combination lock of the invention in an assembled and locked state.

As shown in the drawings, the combination lock of the present invention essentially comprises a housing 1, a dial assembly 2, a press plate 3, and a latch means 4.

The housing 1 is comprised of a front housing portion 11 and a rear housing portion in a butt joint relationship. After assembly, the housing 1 has a plurality of parallel windows 13 both at the front and the back to allow dials 21 to partially expose in the windows 13 at the front and the back sides of the housing 1 to facilitate turning. The right sides of the windows 13 in the front and the back of the housing 1 are protrudently provided with semi-circular curved portions 14 for enveloping shafts 22, to be described hereinafter. In addition, an oblique hole 15 is disposed in the window 13 at the extreme left of the housing 1 for passage of a shaft post 223 of the shaft 22 into a longitudinal housing slot 16. The housing slot 16 has a top portion projecting outwardly and has a stop 161 disposed thereon. The stop 161 is provided with a protrudent left annular seat 162 at an upper portion and an annular groove 163 at an inner side. A seat notch 164 is provided at the joint between two left annular seats 162. In addition, a right annular seat 165 is disposed opposite to the left annular seat 162 at the upper side of the housing 1. The right annular seat 165 is not provided with any holes and is configured to position the latch means 4 when the combination lock is in a locked state. A circular spring slot 17 is disposed opposite to the oblique hole 15 for receiving and positioning a spring 23.

The relevant components in the front housing portion 11 and the rear housing portion 12 are substantially symmetrically disposed for receiving and positioning the components to be described hereinafter. The only difference is that the curved portions 14 of one housing respectively project to form wedge-shaped projections 141 for engaging the shafts 22, and the seat notch 164 is further provided with a projection slot 166 at 90 degrees to facilitate access of a hook projection 415 of the latch means 4 so as to permit change of the pre-set code. In addition, in order that the front housing portion 11 and the rear housing portion 12 can be butt joined and properly positioned, connecting means 18 are respectively disposed therein at suitable positions. For example, in the embodiments shown in the drawings, the connecting means include a post 181 at the front housing portion 11 and an insertion hole 182 correspondingly disposed in the rear housing portion 12.

With reference to FIG. 1 and FIG. 1A, the upper side of the rear housing portion 12 is further provided with a plate positioning means 19 for positioning the press plate 3, comprising a projecting plate 191 and ribs 192 with two sides substantially in the shape of an inverted T.

The dial assembly 2 includes dials 21 that match the windows 13 in number, and shafts 22 to be fitted into the dials 21. Each dial 21 has an inner ring and an outer ring. The inner ring of the dial 21 is provided with a dial hole 211 and peripheral dial teeth 212. After the collar 221 of the shaft 22 is fitted into the corresponding dial hole 211, the shaft teeth 222 at one side of the shaft 22 engage the dial teeth 212. The outer ring of the dial 21 is provided with markings 213 of numbers or letters. When the dials 21 are turned, the shafts 22 are simultaneously turned. And when shaft notches 224 provided on the collars 221 of the shafts 22 engage the wedge-shaped posts 141, that corresponds to the preset code. In order that all the shafts 22 can be connected in series, each shaft 22 is provided with a blind shaft hole 225 at the side opposite to the shaft post 223 thereof. In actual assembly, each shaft 22 is fixedly provided between the curved portions 14 of the housing 1, so that each dial 21 has a part of its markings 213 projecting from the corresponding windows 13 at the front and the back of the housing 1 to facilitate turning. And in order that the shafts 22 have the functions of locking, opening, and code setting, the spring 23 is disposed between the spring slot 17 and the shaft hole 225 at the extreme right.

The press plate 3 is a substantially V-shaped structure provided with a slot 31 at the center corresponding to the projecting plate 191, and retaining slots 32 corresponding to ribs 192, so that the entire press plate 3 may be fixedly provided on the plate positioning means 19. In addition, at that side of the press plate 3 which is adjacent to the dials 21, it is provided with slanting portions 33 that extend downwardly and respectively correspond to the dials 21. Each slanting portion 33 has a tilted end that forms a press portion 34 in contact with the dials 21. When the dials 21 are turned, the press portions 34 engage the clearances 214 of the markings 213 and generate a sound that muffles the faint sound which is produced when the shaft notches 224 engage the wedge-shaped posts 141.

The latch means 4 includes an inverted J-shaped hook 41 and a latch spring 42. The latch spring 42 is accommodated in the space below the stops 161. The entire hook 41 is placed in the housing slot 16 so that a press disk 411 at a bottom end thereof presses against the latch spring 42. An upper end of the press disk 411 is provided with a neck portion 412 of a smaller diameter. A hook post portion 413 of a larger diameter is disposed above the neck portion 412 and is provided with a V-shaped oblique notch 414 for engaging the shaft post 223 at the extreme left in a locked position. When the shaft post 223, neck portion 412, and hook post 413 are connected, this represents the opening and code setting states of the present invention. In addition, the hook 41 is provided with a hook projection 415 corresponding to the seat notch 164 of the housing slot 16 and adapted for displacement within the seat notch 164. A hook end 416 of the hook 41 is located in the right annular seat 165 when the present invention is in a locked state.

Figure 4:
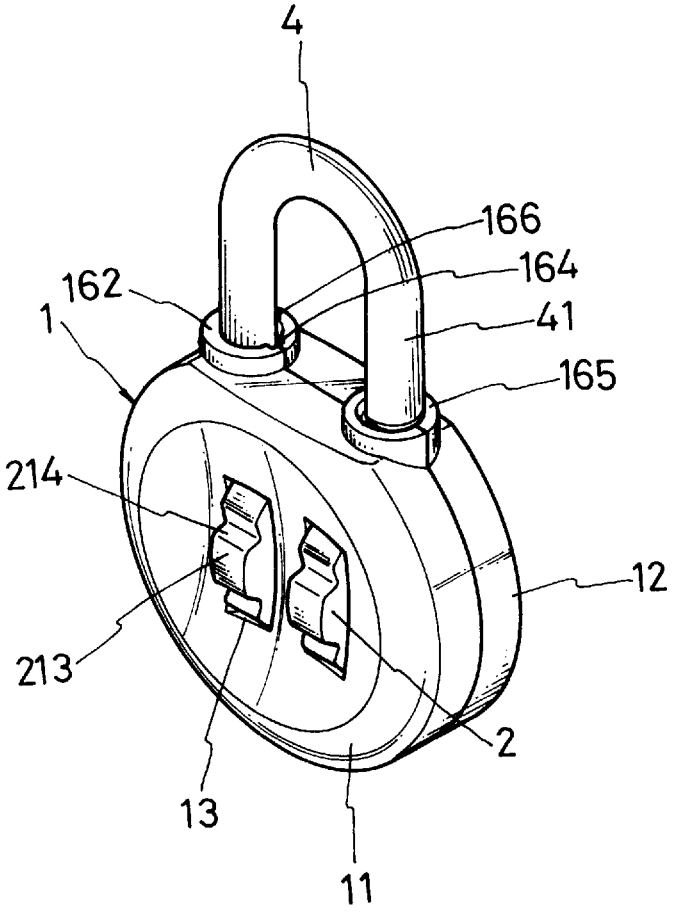
FIG. 4 is a perspective assembled view of the present invention.

FIG. 4 shows the state of the present invention after assembly. To lock the present invention, the hook 41 is turned so that its hook projection 415 aligns with the seat notch 164 of the housing slot 16. The hook 41 is then pressed downwardly so that the shaft post 223 at the outermost end enters the oblique notch 414 along the neck portion 412 of the hook 41. At the same time, the spring 23 is in an stretched state to achieve engagement. Then, by turning the dials 21 at random, the shafts 22 are simultaneously turned so that the shaft notches 224 detach from the wedge-shaped posts 141 to accomplish the locking operation.

To unlock the combination lock according to the present invention, the dials 21 are firstly turned so that the shafts 22 rotate therewith. When the dials 21 have been turned to the positions that match the preset code, the shaft notches 224 will be on the same plane as the wedge-shaped projections 141. Then the hook 41 may be pulled up so that the shaft post 223 at the outermost side is pushed by the neck portion 412 to displace to the right, thereby urging against the spring 23. At this point, the shaft notches 224 will enter the wedge-shaped projection 141 halfway, accomplishing the unlocking operation. At this point, the shaft teeth 222 still engage the dial teeth 212.

If it is desired to set a new code, the dials 21 are first turned so that they are turned to the preset code. Then the hook 41 is pulled up so that the hook projection 415 disengages from the seat notch 164 of the housing slot 164. Then the hook 41 is turned about 90 degrees so that the hook projection 415 is aligned with the projection slot 166. The hook projection 415 is then pressed downwardly so that it falls into the annular groove 163 and is then turned through 90 degrees to permit contact between the hook post 413 and the shaft post 223 at the outermost side, causing the shafts 22 to push to the right and the shaft notches 224 to fit into the wedge-shaped projections 141 completely. The shaft teeth 22 then disengage from the dial teeth 212. At this point, turning of the dials 21 will not bring the shafts 22 to rotate therewith. After the dials 21 have been turned to the new code, the hook 41 is turned clockwisely through 90 degrees and pulled up so that the hook projection 415 disengages from the projection slot 166, allowing contact between the shaft post 223 and the neck portion 412. At this time, the spring 23 is in a stretched state, causing the shaft teeth 222 to engage the dial teeth 212. The hook 41 is turned clockwisely through 90 degrees and pressed downwardly so that the hook projection 415 falls into the seat notch 164 of the stop 16, causing the shaft post 223 to engage the hook notch 414, thus accomplishing the code setting operation. At this point, by turning the dials 21 randomly, the combination lock of the present invention will become locked again.

In the present invention, it is not necessary to additionally provide a spindle at the center of the dials and shafts or a collar to urge against the shafts so that new codes can be set. The shafts in the present invention can be connected in sequence, and each shaft is fitted into the corresponding dial to accomplish assembly of the dial assembly. Besides, in the present invention the code can be easily set by separating the hook projection of the hook from the seat notch and turning it so that the hook projection enters the annular groove. Furthermore, by controlling whether the shaft post is in contact with the hook notch and the hook post, the present invention may be locked or unlocked.

Although the present invention has been illustrated and described with reference to the preferred embodiment thereof, it should be understood that it is in no way limited to the details of such embodiment but is capable of numerous modifications within the scope of the appended claims.

What is claimed is:

1. A combination lock, comprising:

a housing, including a front housing portion and a rear housing portion in a butt joint relationship, said front housing portion and said rear housing portion being respectively provided with a plurality of windows having a curved portion at one side, a vertical housing slot at one side thereof, a left annular seat disposed at a top end of said housing slot at one end of each housing portion, with a right annular seat disposed at the other end, said curved portions of each housing portion being provided with wedge-shaped projections, said housing slot being provided with a stop and an oblique hole at suitable positions, said oblique hole being further provided with a spring slot at one end, said left annular seat having a seat notch, said windows of said housing portion with said wedge-shaped posts being provided with a plate positioning means;

a dial assembly, including a plurality of dials and shafts connected in series, each dial having an inner ring provided with inner dial teeth, an outer ring with corrugated outer projections having respective markings thereon, and clearances between adjacent outer projections, said shafts being disposed in opposed curved portions of said housing portions, each shaft including a shaft post at one end, a blind shaft hole at the other end, a collar disposed intermediate said shaft post and said shaft hole and having a shaft notch at one side for engaging the corresponding wedge-shaped projection of said housing, the first of said shafts having said shaft post thereof passing through said oblique holes into said housing slots with said shaft hole thereof receiving the shaft post of an adjacent shaft, a spring disposed between the last of said shafts and said spring slot;

a press plate, including a slot and retaining slots, and being connected to said plate positioning means for positioning said clearances;

a latch means, including a hook and a latch spring disposed in said housing slots of said housing portions, said hook including a hook body having a hook projection thereon, a disk at a bottom end, a neck portion above said disk, a hook post of a larger diameter than that of said neck portion above said neck portion and having an oblique notch at one side, and a hook end, whereby when said dials are turned to a preset code, said hook is pulled upwardly so that said hook projection extends out of said seat notch and said shaft post of the first of said shafts causes the dial assembly to displace to one side due to the clearance between said hook notch and said neck portion so that said shaft notches engage the corresponding wedge-shaped projections; and when said hook is pressed downwardly, said hook projection enters said seat notch to cause said shaft post of the first of said shafts to fare into said hook notch so that said spring reset to bring said dial assembly to displace to the other side and cause said shaft notches to disengage from the corresponding wedge-shaped projections to achieve locking.

2. A combination lock as defined in claim 1, wherein said seat notch is further provided with a projection slot running vertically thereto, said projection slot communicating with an annular groove in said left annular seat such that when said hook projection extends out of said seat notch and is pressed downwardly in the direction of said projection slot, with said hook turned reversely so that said hook post pushes the entire dial assembly, causing said shaft notches to engage completely with said wedge-shaped projections, further causing said dial teeth to disengage completely from said shaft teeth, thereby a new code can be set by turning said dials to a desired new code and operating said hook in a reverse direction.

3. A combination lock as defined in claim 1, further comprising a connecting means which includes a post and an insertion hole for receiving said post.

4. A combination lock as defined in claim 1, wherein said plate positioning means includes a projecting plate and a plurality of ribs for respectively engaging said slot and said retaining slots of said press plate.

5. A combination lock as defined in claim 1, wherein said press plate is provided with slanting portions corresponding to said dials, each of said slanting portions having a press portion at a distal end thereof for pressing said clearances of said dials.

6. A combination lock as defined in claim 1, wherein said markings on said dials are numerals or letters.

* * * * *